United States Patent [19]

Bryant

[11] 4,302,195

[45] Nov. 24, 1981

[54] POWERED TILTING TRANSOM FOR OUTBOARD BOATS

[76] Inventor: Gerald F. Bryant, P.O. Box 1402, Jonesboro, Ark. 72401

[21] Appl. No.: 60,176

[22] Filed: Jul. 24, 1979

Related U.S. Application Data

[63] Continuation-in-part of Ser. No. 858,840, Dec. 8, 1977, abandoned.

[51] Int. Cl.[3] ..... B63H 5/12

[52] U.S. Cl. ..... 440/61; 248/640

[58] Field of Search ..... 9/1.6; 248/640-643; 440/58-63

[56] References Cited

U.S. PATENT DOCUMENTS

| | | | |
|---|---|---|---|
| 2,886,462 | 5/1959 | Jagiel | 115/17 |
| 2,916,009 | 12/1959 | Baird | 115/41 R |
| 2,928,630 | 3/1960 | Wisman | 115/41 R X |
| 2,930,218 | 3/1960 | Ashmore | 248/640 X |
| 2,953,335 | 9/1960 | Kiekhaefer | 115/41 R |
| 3,073,279 | 1/1963 | Moody | 115/41 HT |
| 3,246,915 | 4/1966 | Alexander, Jr. | 115/41 R X |
| 3,250,240 | 5/1966 | Ziegler | 115/17 |
| 3,638,256 | 2/1972 | McIntyre | 248/641 |
| 3,864,770 | 2/1975 | Zeilinger | 9/1.6 X |

*Primary Examiner*—Sherman D. Basinger

[57] ABSTRACT

This invention relates to a power tilting transom that fits over the pre-existing transom of an outboard motor boat. The transom defines a universal motor mounting surface for a variety of outboard motors and a pair of hydraulic cylinders that drive the tilting transom outwardly and upwardly when energized. This raises the prop shaft and propellor of the outboard motor out of the water.

16 Claims, 11 Drawing Figures

FIG. 1
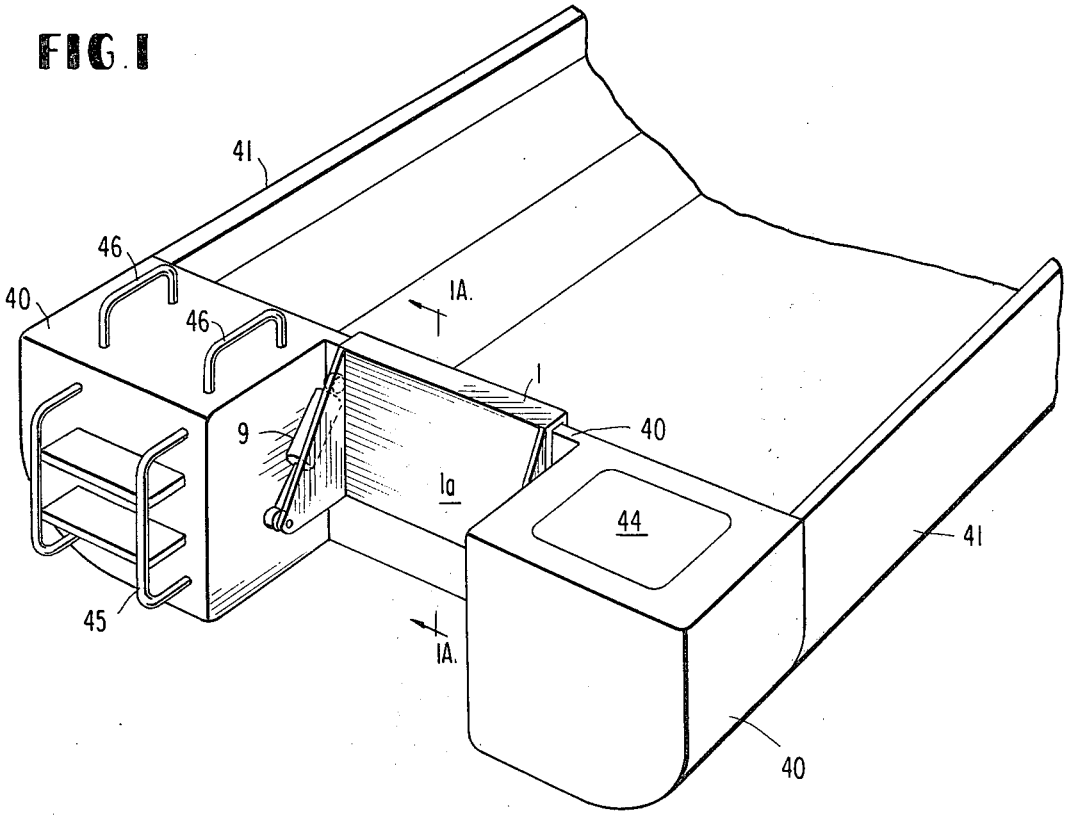
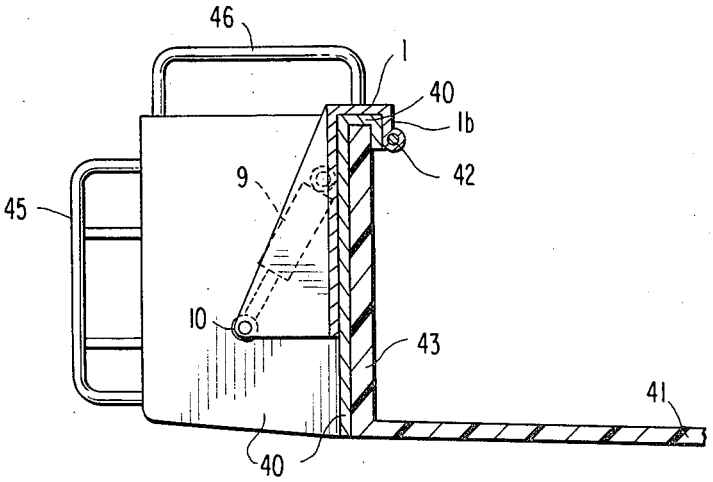
FIG. 1A

POWERED TILTING TRANSOM FOR OUTBOARD BOATS

BACKGROUND OF THE INVENTION

This application is a continuation-in-part of my prior application "Universal Power Tilting Boat Transom for Outboard Boats," U.S. Ser. No. 858,840 filed Dec. 8, 1977, now abandoned.

The present invention is a tilting transom that is adapted to be installed on a fixed transom boat to provide that boat with the advantages of a tilting transom boat.

Small outboard motor boats normally have fixed rear transoms. These boats are normally equipped with a wide variety of outboard motors, ranging from small fishing motors to large water skiing motors. When larger motors are installed, it becomes difficult to alter the trim of the motor, or to raise the prop shaft of the motor for beaching or navigating in vegetation infested waters.

The present invention fits over the pre-existing transom, and provides a tilting transom for the boat to change the angle of the motor and prop shaft when desired. The new tilting transom is equipped with a universal mounting surface to receive a wide variety of outboard motors, and is also equipped with a pair of hydraulic cylinders for remote operation.

PRIOR ART STATEMENT

The following patents were cited by the Patent Office during the prosecution of my prior application U.S. Ser. No. 858,840 referred to above:

U.S. Pat. No. 3,250,240 entitled "Starting Motor Power Take-off" issued to K. F. Ziegler on May 10, 1966 describes a motor for outboard boats with a starting motor that can be disengaged to drive a pair of hydraulic cylinders to tilt the motor. Both the Ziegler reference and my invention tilt the motor; however, Ziegler's patent describes an improvement in outboard motors, while my invention relates to an improved tilting transom for boats that is useful with a wide variety of motors, and is not restricted to a single motor. It can be used with a pair of motors or a single motor, and for each given size of transom, is adaptable to a wide variety of boats within that size range.

While Ziegler can be adapted to a wide variety of boats, his invention is limited to his motor, or to the motor on which his improvement is installed, and cannot receive a wide variety of motors.

Applicant's invention is also an improvement over Ziegler in that the center of weight distribution for Ziegler is above the boat, whereas applicant has his center of weight distribution inside the boat. Since the present invention is particularly adapted to the use of larger motors on small boats, this improvement is very important. The bigger the motor, or the smaller the boat, the more important good weight distribution becomes.

Finally the physical structures used by Ziegler and applicant are completely different. Applicant describes and claims a tilting transom, which is a large flat member covering the rear of the boat, which Ziegler describes and claims a hydraulic motor and motor mount. The only structual similarity is the use of hydraulic pistons to provide remote control of the tilting function.

U.S. Pat. No. 2,953,335 to E. C. Kiekhaefer for "Outboard Propulsion Units for Boats" and U.S. Pat. No. 3,246,915 issued to C. F. Alexander, Jr., for "Outboard Propulsion Units for Boats" are both directed to shock absorbing mounts for outboard boat motors. They are relevant to the shock mounts disclosed in FIG. 5 of the present application, and claimed in some of the dependent claims. As in Ziegler, the structures shown in Kiekhaefer and Alexander are an integral part of, and limited to the motors. Applicant's invention is a universal transom and is adapted to receive a wide variety of motors, both with respect to the tilting feature and the shock absorbing features.

The Patent Office has also cited three patents that disclose outboard motor mounting brackets.

U.S. Pat. No. 3,073,279 to L. C. Moody for an "Outboard Motor Mount" which issued Jan. 15, 1963.

U.S. Pat. No. 2,928,630 to A. P. Wisman for an "Assembly for Supporting an Outboard Motor" which issued Mar. 15, 1960.

U.S. Pat. No. 2,886,462 to Z. J. Jagiel for a "Boat Attachment" which issued on May 12, 1959.

Each of these patents disclose an outboard mounting device which extends rearwardly of the boat and places the weight distribution of the motor outside the boat and 8 to 12 inches to the rear.

This causes general instability and with larger motors on small boats will cause porpoising of the boat and cavitation of the propellor.

In addition to these drawbacks, the pivot point, illustrated by Moody, would cause the outboard motor to strike the transom if the tilt angle were more than 20 or 25 degrees. This is not enough to get the propellor out of water. As illustrated in FIG. 7 of Moody, part of the transom has been cut away to provide clearance for the motor. In addition, Moody requires that bolt holes be drilled below the waterline, and a large opening be left in the transom wall which could lead to leakage and inadvertent shipping of water.

Applicant's invention avoids these problems by placing the center of pivot inside the boat and below the gunnales and transom. This provides a vastly improved weight distribution and handling improvement.

The primary object of this invention is to provide a tilting boat transom for outboard boats that permits selectively tilting the transom automatically to different angles relative to the bottom of the boat.

SUMMARY OF THE INVENTION

It is an object of this invention to provide power tilting transom for all outboard boats to accommodate all outboard motors.

It is another object of the invention to provide means to automatically change the angle of the transom, thereby changing the angle of the outboard motor in respect to the bottom of the boat.

It is another object of the invention to provide a universal tilting transom so that it will fit virtually all outboard boats, and virtually all outboard motors will fit onto the universal tilting transom.

It is another object of the invention to provide a tilting transom by placing a unique metal transom plate over the pre-existing boat transom. The pivot point for the transom plate is inside the boat transom, and defined by a pair of support brackets mounted to the boat transom on opposite sides of the tilting transom plate, allowing the bottom of the plate to swing freely.

It is another object of the invention to provide a power tilting transom by providing a pair of power cylinders hinged with the body ends of the cylinders to the back side of the support brackets and the shaft end of the cylinders hinged to the bottom of the tilting transom plate. The transom plate will tilt from the bottom, out and up, when power is applied to the cylinders, thereby changing the angle of the transom with respect to the bottom of the boat. Changing the angle of the transom will therefore change the angle of the outboard motor attached thereon.

Another object of this invention is to provide the outboard boat with a power tilting transom that will automatically lower and raise the motor to and from the water, as for landing the boat in shallow water at the waters edge, or for trailering the boat.

Another object of the invention is to provide a universal tilting transom that will fit all outboard boats without any alterations to the boats.

Another object of the invention is to provide a universal motor mounting surface so that any outboard motor, large, or small, including short shaft, standard shaft and long shaft will fit the power tilting transom without adding or removing any parts to or from the motor.

All original parts of the motor may remain on the motor and be operational, including the shock absorbers and trip mechanisms.

Another object of the invention is to provide a power tilting boat transom that will support and accommodate two (2) outboard motors for twin-hook-up while using only one (1) tilting transom unit.

Another object of the invention is to provide a power tilting transom in one compact unit so that outboard boat owners can install it simply and quickly.

Another object of this invention is to provide a boat with a power tilting transom that can be factory installed at the time the boat is manufactured, thereby allowing the boat manufacturer to equip new boats with power tilting transoms.

It is another object of this invention to permit the motor to be removed from the transom for repairs without removing any part of the power tilting transom unit.

Other objects and advantages of the invention will become apparent during the course of the following detailed description of the preferred embodiments.

FIG. 1 is a perspective view of one embodiment of the tilting transom of the present invention attached to an outboard motor boat.

FIG. 1A is a cross sectional view taken along section line 1A—1A of FIG. 1.

THE DETAILED DESCRIPTION OF THE PREFERRED EMBODIMENT

Figure 2:
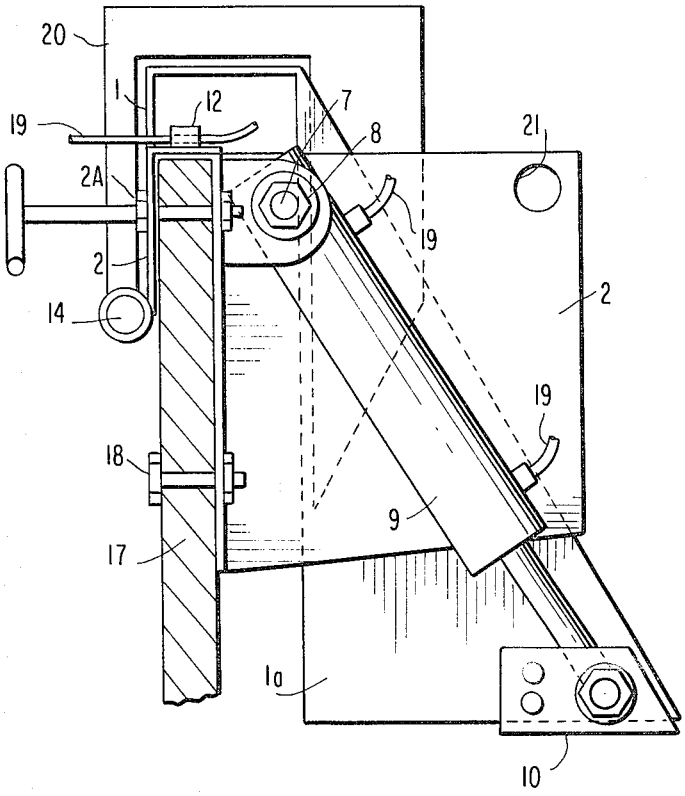
FIG. 2 is a side elevation view of the preferred embodiment of the invention with the transom in the down position.
Figure 3:
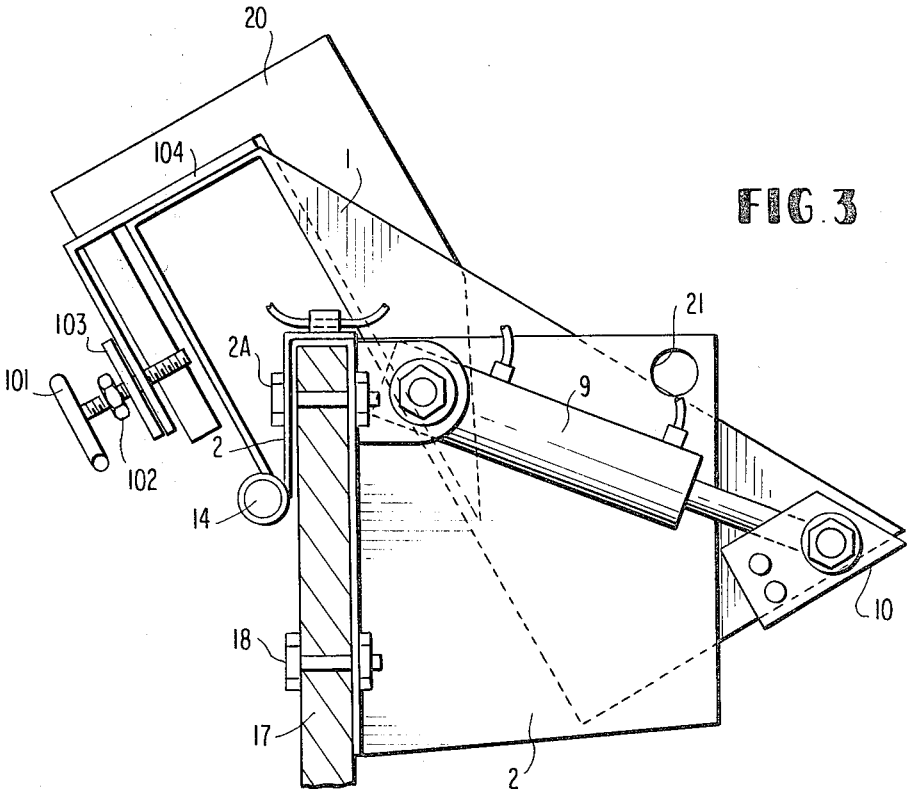
FIG. 3 is a side elevation view of the preferred embodiment of the invention with the transom in the tilted or raised position.
Figure 4:
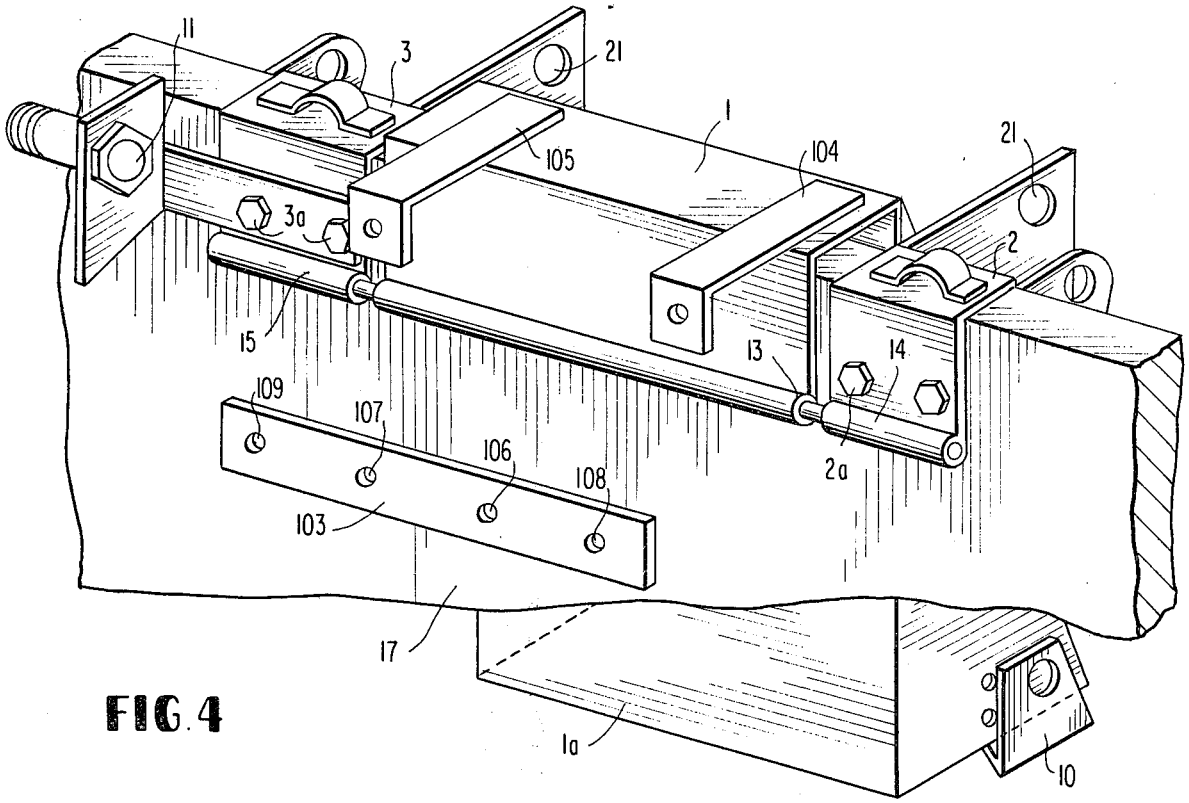
FIG. 4 is an isometric view of the preferred embodiment of the invention from inside the boat.

The preferred embodiment of the invention is illustrated in FIGS. 2, 3 and 4. As illustrated therein, a pre-existing boat transom 17 has been covered with a pivotable transom plate or jacket means 1 having an inverted J shape pivotable portion and a planar back plate portion 1A. The transom plate means pivots about a horizontal transverse defined by hinge members 13, 14 and 15. This hinge and horizontal transverse axis is located inside the boat and below the top of the pre-existing transom. The tilting transom plate together with the back plate portion 1A defines a universal mounting surface for engaging a variety of outboard motors.

The pivotable transom plate means is secured to the pre-existing transom by virtue of a universal mounting means 2 and 3 which are secured to the transom by means of bolts **2*a* and 3*a*. It is understood that while FIGS. 2–4 illustrate the universal mounting means as a pair of inverted J-shaped brackets, the mounting means could be formed from a single bracket underlying the transom plate means and providing pivot means on either end of the horizontal axis of rotation defined by hinge member 13**.

The tilting transom means also includes a pair of hydraulic cylinders, one of which is illustrated as 9 in FIGS. 2 and 3. The hydraulic cylinders are pivotally anchored at their base end by means of bolt 7 and lock nut 8 which secures the cylinder to the universal mounting means. The driven end of the hydraulic cylinders is mounted on bracket 10 which is attached to the pivotal transom plate 1 as illustrated in FIGS. 2 and 3.

When the tilting transom is at rest, it assumes the position illustrated in FIG. 2. When the hydraulic cylinders are actuated the tilting transom plate pivots about the horizontal axis defined by hinge 14 as illustrated in FIG. 3.

The pivot point for the transom plate and the center of weight distribution for the motor is transferred inside the boat and below the top of the pre-existing transom 17. This configuration provides a superior weight distribution since the center of weight distribution is lowered as well as being brought inside the boat.

Depending on the geometry and angles selected, the hydraulic cylinders may be powered in or powered out. In either case, the lower most portion of the back plate **1*a* is driven outwardly and upwardly away from the pre-existing boat transom 17. As illustrated in FIGS. 2 and 3 an outboard motor has been represented by mounting clamp 20 which illustrates the manner in which the transom plate means 1** receives a typical outboard motor.

The tilting transom plate defines a J-shaped cross section and is substantially planar. If desired it can be extended across the entire width of the transom (as will be hereinafter later described) to provide a mounting surface for two outboard motors. The tilting transom plate defines as practically as possible the normal surface contour of a boat transom thereby facilitating its use by a variety of outboard motor configurations.

Similarly the J-shaped mounting means 2 and 3 are adapted to fit a variety of boat transoms. Hence the transom means of the present invention is universal with respect to both the boat on which it is mounted and the motor which is mounted thereon.

As can be best seen from FIG. 4, the hinge portion 13 extends the entire width of the tilting transom plate 1 and aligns correspondently between hinge portion 14 of support bracket 2 and hinge portion 15 of support bracket 3 to receive a tie bolt which extends through hinge portions 14, 13, and 15 respectively, and locked at each end by lock nuts. This allows the tilting transom plate 1 to swing freely from the bottom, in a down and in direction, or an up and out direction; relative to the bottom of the boat, as shown in FIGS. 2 and 3.

The body ends of the power cylinders 9 are pivotally attached between the two rearwardly projecting portions of the support brackets 2 and 3.

As seen in FIG. 2 and 3 both sides of the tilting transom plate 1 projects to the rear to provide means and apertures for attaching the hydraulic cylinders 9 to the bottom of the tilting transom plate. Bracket 10 provides a reinforced mount for attaching the shaft end of the power cylinders 9 to the bottom of the rearwardly projections of tilting transom plate 1. (Shown, FIGS. 2 and 3)

Support brackets 2 and 3, and tilting transom plate 1, are structured to fit over the boat transom 17, as shown in FIG. 4. The tilting boat transom is secured to the boat transom by bolts 2*a*. A steering cable connection hook up 11 is provided for motors without this provision. It may be attached to the front of the tilting transom plate 1, or fixed to the front of support bracket 3, as illustrated in FIG. 4.

The cylinders' hoses 19 may be connected to the preferred power source, such as, an electrically powered hydraulic pump, or hand operated hydraulic pump to cause power cylinders 9, when power is applied, to force the bottom of tilting plate 1 from a down position, illustrated in FIG. 2, to a raised position, illustrated in FIG. 3. It is apparent that reversing or releasing the power will reverse the movement of the tilting transom plate 1.

The outboard motor is clamped and secured onto the tilting transom plate 1 by means of the motor clamp 20, rather than to the boat transom 17, as is the normal procedure. Obviously, the motor will then be raised and lowered in conjunction with the tilting transom plate 1. For clarity, only the clamp 20 of the motor is shown positioned onto the tilting transom plate 1, FIGS. 2 and 3.

A motor lock is illustrated in FIGS. 3 and 4. As illustrated in FIG. 4, a pair of extension arms 104 and 105 are welded or secured to the tilting transom plate 1. A motor lock 103 is secured through bolt holes 108 and 109 matching holes on extension arms 104 and 105.

As illustrated in FIG. 4, the outboard mounting clamp bolt 101 is equiped with a lock nut 102 and extends through openings 106 and 107 in motor lock 103 (See FIG. 4) to the threaded openings of motor clamp 20.

Figure 9:
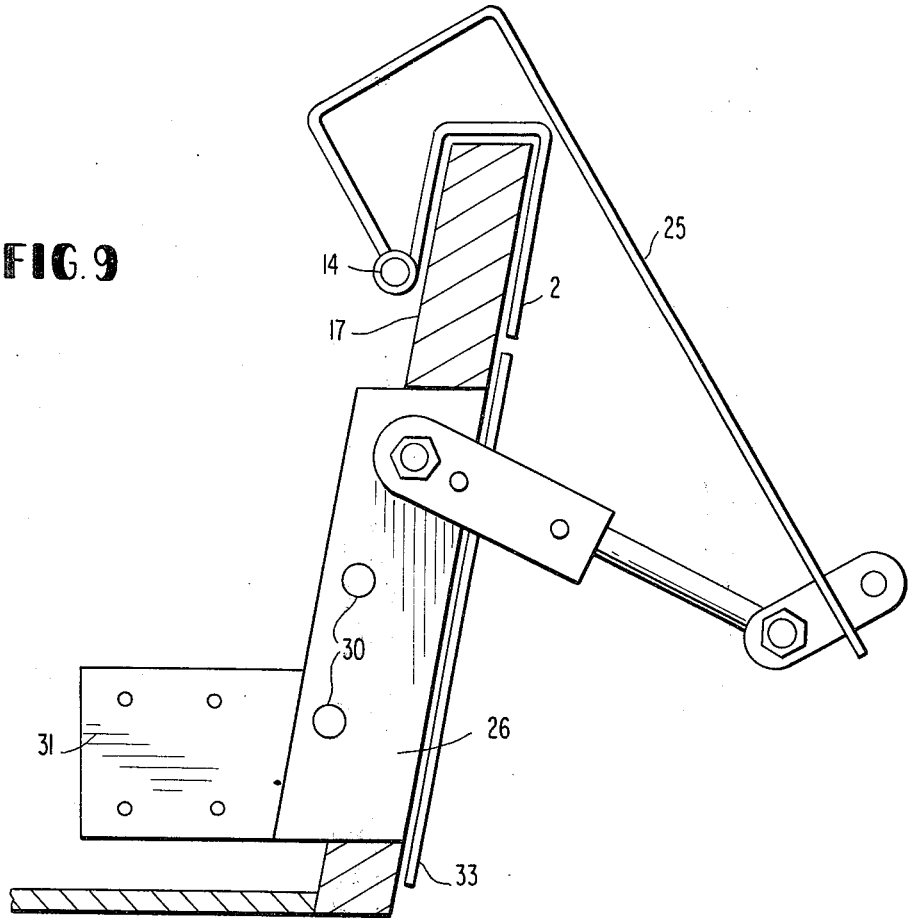
FIG. 9 is a side view of another embodiment of the invention with a single power cylinder between the transom and the tilting transom plate.
Figure 10:
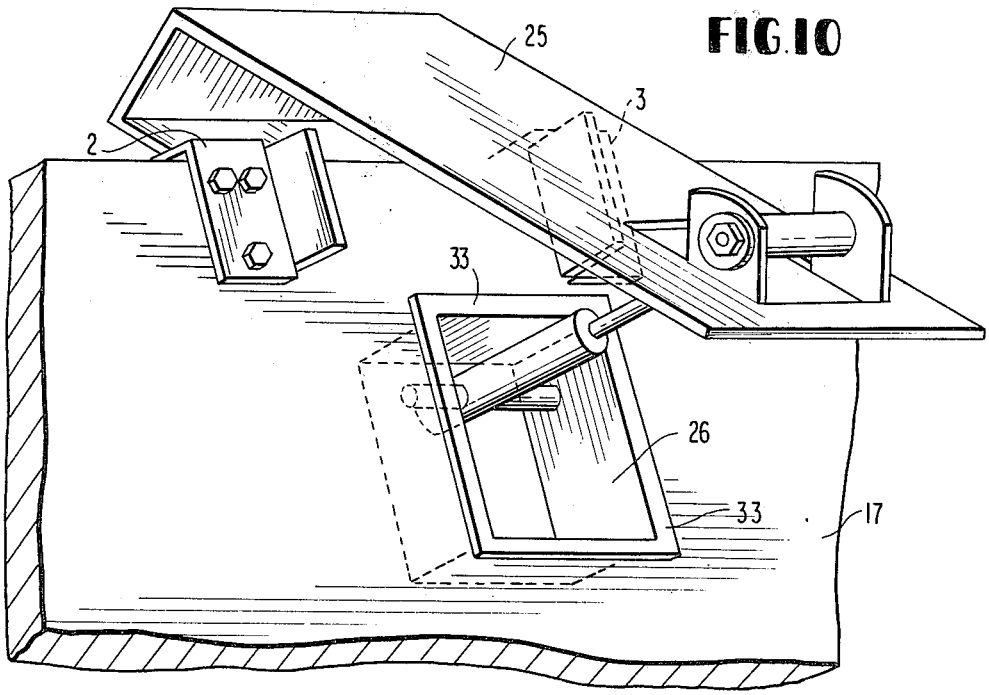
FIG. 10 is a isometric view from the rear of the boat showing the single power cylinder support illustrated in FIG. 8.

An alternate embodiment of the invention is illustrated in FIGS. 9 and 10. In this embodiment, mounting means 2 and 3 are U-shaped. This embodiment enables one to use a single hydraulic cylinder rather than a pair if desired, and a recessed mounting means 26 for the hydraulic cylinder.

Support housing 26 also provides a mounting plate 31 for mounting the hydraulic pump, and contains two (2) through housing couplings 30 for attaching the hydraulic hoses. The cylinder hoses are connected to the couplings 30 on the inside of housing 26, the pump may be mounted on plate 31, and the pump hoses connected to couplings 30 on the outside of housing 26. An opening may be made in the boat transom for installing housing 26 through the boat transom. Flange 33 of housing 26 is securely fitted to the boat transom with screws or bolts through flange 33.

Figure 5:
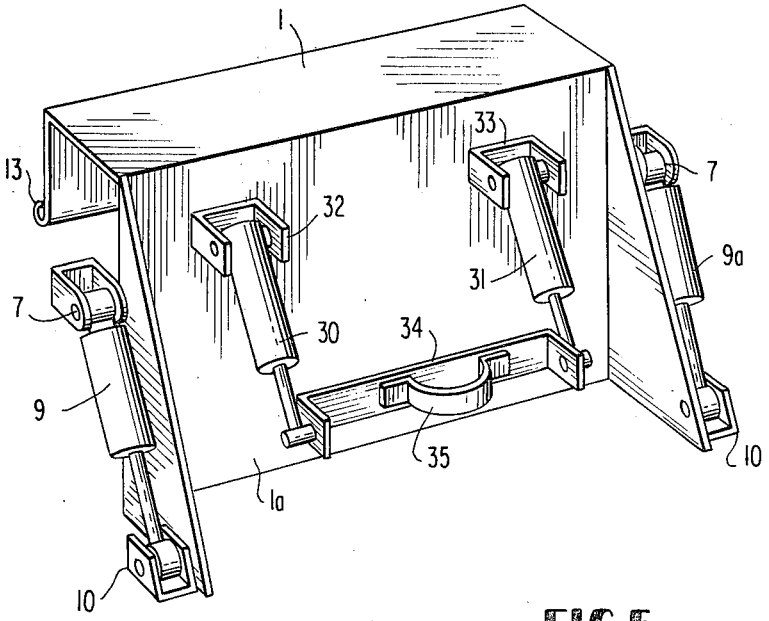
FIG. 5 is an isometric view of the preferred embodiment of the invention with additional shock absorbing means installed.

An improvement for the preferred embodiment of the invention is illustrated in FIG. 5.

The pivotable transom plate 1 is further equipped with a pair of shock absorbers 30 and 31 which are attached to the transom plate 1 by means of mounting brackets 32 and 33. The shock absorbers have mounted on the free end, a tie bar which is adapted by means of clamp 35 to be secured to the drive tube of an outboard motor. When mounted to pivot with respect to motor clamp 20 (shown on FIGS. 2 and 3, and secured to pivoting shock absorbers 30 and 31) the motor is protected from sudden changes in displacement due to power surges, submerged objects or wave action.

When mounted on the transom means illustrated in FIG. 5, the motor may pivot about two separate axis. The first being a damped motion with respect to motor clamp 20, and the second, a controlled pivot with respect to axis 14.

Another embodiment of the invention is illustrated in FIGS. 1 and 1A. In this embodiment, the tilting transom means defines a horizontal transverse member 40 which extends across the width of boat 41. A pivot means 42 (illustrated in FIG. 1A) is provided inside the boat below the top of the transom means 40. The transom means is adapted to fit over and supplant the pre-existing transom 43. The transom means may also define a live bait well 44, and steps 45 and safety grips 46.

FIG. 1A is taken from section line 1A—1A shown in FIG. 1. The tilting transom plate 1, extends from inside the transom to the exterior of the transom 1*a* by virtue of its inverted J configuration. The tilting member 1 defines a planar universal motor mount means which is adapted to receive a variety of outboard boat motors.

The power cylinders 9 are mounted between the transverse member 40 and the tilting means 1*a* to move the exterior portion 1*a* upwardly and outwardly when power is applied.

The transom plate comprises an inverted J member with the bight of the J fitting over the transverse member. The short leg of the J, 1*b* extends downwardly to the pivot means 42, while the long leg of the J 1(*a*) extends downwardly on the exterior of the transverse member to define a universal planar mounting surface for a wide variety of outboard motors.

Figure 6:
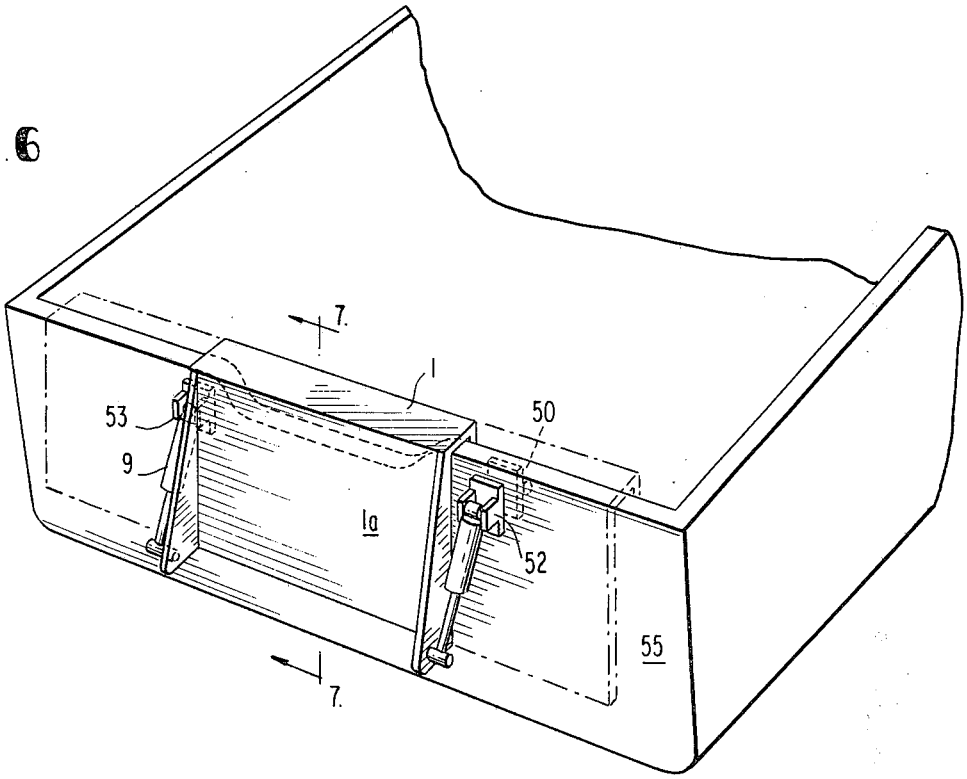
FIG. 6 is an isometric view of an alternate embodiment of the invention illustrating the mounting means and transom plate fitted to a pre-existing boat transom.
Figure 7:
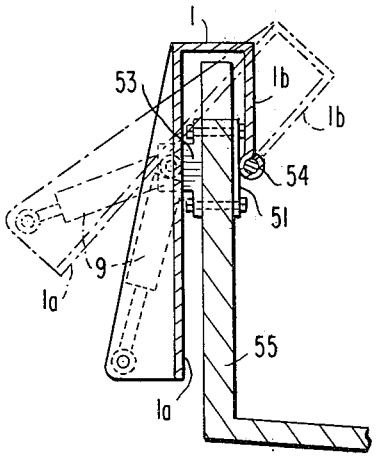
FIG. 7 is a partially sectioned cross view of section line 7—7 of FIG. 6.
Figure 8:
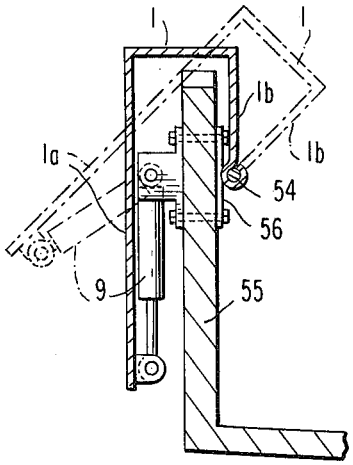
FIG. 8 is a partially cross sectional view of another embodiment of the invention taken along section line 7—7 of FIG. 6.

Fourth and fifth embodiments of the invention are illustrated in FIGS. 6 to 8.

In these embodiments, the transverse member has been replaced with a pair of spaced pivot means 50 and 51 mounted inside the boat and matching exterior mounting brackets 52 and 53.

The pivot means 50 and 51 define a horizontal transverse axis 54 which is positioned within the boat and below the transom 55 of the boat. The transom plate 1 is illustrated at rest in FIG. 6–8 with the tilted position illustrated in dotted lines in FIGS. 7 and 8. In each embodiment, the pivot point, and the center of weight distribution is inside the boat and below the top of the transom 55.

As illustrated, the transom plate 1 supplants and replaces the pre-existing transom 55. As illustrated in FIGS. 6 (dotted lines) and FIG. 8, the tilting transom extends transversely across the boat from gunnel to gunnel and completely replaces the pre-existing transom 55.

In this embodiment, the hydraulic cylinders 9 may be mounted entirely under the tilting transom 1, or may be mounted as illustrated in FIGS. 9 and 10.

When a full width tilting transom is provided as in FIGS. 6 and 8, the horizontal axis of rotation or pivot 54 may be defined by a long piano type hinge member 56, or by a pair of more substantial interior hinges as illustrated by 50, 51 in FIGS. 6 and 7.

Each of the embodiments of the invention place the pivot point inside the boat, below the top of the pre-existing transom.

This brings several improvements over previous tilting motor mounts. The center of weight distribution is brought inside the boat and lowered. This results in greater stability and improved handling, rather than impairing the handling characteristics. Secondly, all existing service components such as steering cables, fuel lines, and electrical connections may be standard and need not be altered.

The motor is maintained in its standard position for normal usage, and brought inside when tilted. Thus existing service lines are sufficient.

While the preferred embodiment, and several alternate embodiments have been described in detail, it is to be understood that various modifications and alterations could be made without departing from the scope of the invention. Accordingly, the invention is defined by the scope of the following claims:

I claim:

1. A powered tilting transom jacket for outboard motorboats, said jacket adapted to engage a variety of different boat transoms, and secure a variety of different outboard motors have mounting clamps, said transom jacket comprising:

(a) mounting means for securing said transom jacket to a pre-existing transom of an outboard motorboat, said mounting means adapted to be mounted on a variety of pre-existing transoms, said mounting means defining a pivot point inside the boat, below the top of the transom, (b) a transom jacket for covering portions of the interior, top and exterior of said pre-existing boat transom, said jacket defining planar members on the interior and exterior of said boat with an inverted J-shaped cross section, the short leg of the J descending downwardly on the interior of the boat to said pivot point, the long leg of the J descending downwardly on the exterior of the pre-existing transom, said transom jacket connected to said mounting means at said pivot point to enable said transom jacket to be tilted from a first position to a second position, (c) said planar members of said transom jacket defining an outboard motor mount for securing one or more outboard motors to said boat, said motors being mounted with their mounting clamps directly over the pre-existing transom when said transom jacket is in its first position, said transom jacket being arranged to pivot about said pivot point to bring said motor upwardly and inwardly of said pre-existing transom when said transom jacket is tilted to its second position, (d) hydraulic cylinder means mounted to one of the downwardly descending legs of said transom jacket to tilt said transom jacket upwardly and inwardly of said pre-existing transom.

2. A powered tilting transom jacket as claimed in claim 1 wherein said mounting means defines an inverted J-shaped channel member underlying said J-shaped transom jacket.

3. A powered tilting transom jacket as claimed in claim 1 wherein said mounting means defines a pair of inverted J-shaped brackets on either side of said inverted J-shaped transom jacket.

4. A powered tilting transom jacket as claimed 1 wherein said mounting means further defines a pair of inverted U-shaped brackets on either side of said inverted J-shaped transom jacket.

5. A powered tilting transom jacket as claimed in claim 1 wherein said hydraulic cylinder means further comprises a pair of hydraulic cylinders mounted on either side of said inverted J-shaped transom jacket.

6. A powered tilting transom jacket as claimed in claim 5 wherein said mounting means further comprises a pair of pivot mounts on the interior of the boat on said pre-existing transom, with a pair of power cylinder mounts mounted on the exterior of said pre-existing transom, with said power cylinder mounts and said pivot mounts being mounted back to back.

7. A powered tilting transom jacket as claimed in claim 1 wherein said hydraulic cylinder means is mounted between the pre-existing transom and one of the downwardly descending legs of said transom jacket to tilt said transom jacket upwardly and inwardly of said pre-existing transom.

8. A powered tilting transom jacket as claimed in claim 1 wherein said transom jacket has mounted on its exterior portion a pair of shock absorber means for mounting an outboard motor to said tilting transom jacket.

9. A powered tilting transom jacket as claimed in claim 1 wherein said tilting transom jacket further comprises a motor lock, said lock defining a pair of extension arms and a front locking bar adapted to secure the outboard motor to said tilting transom jacket.

10. An outboard motor boat with a powered tilting transom, said transom adapted to receive and secure a variety of different outboard motors, each of said motors having mounting clamps for securing said motor to said transom, said boat comprising:

(a) side walls, a stern and a pre-existing transverse fixed transom member extending across the stern of said boat, said powered tilting transom defining a pivot mounting means on the interior of the boat below the top of the pre-existing transverse fixed transom member said powered tilting transom also defining at least one power cylinder mount on the exterior of said boat, (b) a transom jacket for covering portions of the interior, top and exterior of said fixed boat transom, said jacket defining planar members on the interior and exterior of said boat with an inverted J-shaped cross section, the short leg of the J descending downwardly on the interior of the pre-existing transverse fixed transom member to said pivot mounting means, the long leg of the J descending downwardly on the exterior of the pre-existing transverse fixed transom member, said transom jacket connected to said powered tilting transom at said pivot mounting means to enable said transom jacket to be tilted from a first position to a second position, (c) said planar members of said transom jacket defining an outboard motor mount for securing one or more outboard motors to said boat, said motors being mounted with their mounting clamps directly over the pre-existing transverse fixed transom member when said transom jacket is in its first position, said transom jacket being arranged to pivot around said pivot mounting means to bring said motor upwardly and inwardly of said pre-existing transverse fixed transom member when said transom jacket is tilted to its second position, (d) power cylinder means mounted between said power cylinder mount and the exterior downwardly decending leg of said transom jacket to tilt said transom jacket upwardly and inwardly of said pre-existing transverse fixed transom member when said power cylinder is energized.

11. An outboard motor boat as claimed in claim 10 wherein said powered tilting transom further includes an inverted J-shaped means which extends downwardly on both sides of said pre-existing transverse fixed transom member defined by said boat, the short leg of said J descending into the interior of said boat below the point at which said outboard motor mounting clamps engage said transom jacket.

12. An outboard motor boat as claimed in claim 10 wherein said powered tilting transom further defines step means and bait well means.

13. An outboard motor boat as claimed in claim 10 wherein said transom jacket extends transversely across the stern of said boat, said transom jacket and said powered tilting transom being connected by a horizontal hinge extending transversely across the interior of the boat.

14. An outboard motor boat as claimed in claim 10 wherein said pivot mounting means further comprises a pair of pivot mounts mounted on the interior of the boat on said pre-existing boat transom and a pair of power cylinder mounts mounted on the exterior of said pre-existing boat transom, said power cylinder mounts and said pivot mounts being mounted back to back.

15. A powered tilting transom to be fitted over the pre-existing transom of an outboard motor boat, said tilting transom adapted to engage a variety of pre-existing transoms, and secure thereto a variety of outboard motors, each of said motors having mounting clamps for securing said motors to said tilting transom, said tilting transom comprising:

(a) a universal mounting means for attachment to a variety of pre-existing boat transoms, said means defining at least one inverted U-shaped channel member which is mounted over said pre-existing transom with the legs of said channel member extending downwardly on either side of said pre-existing transom, the inner leg of said channel member defining a horizontal transverse pivot point inside the boat below the top of said transom, (b) a transom jacket for covering portions of the interior, top and exterior of said pre-existing boat transom, said transom jacket defining planar members on the interior and exterior of said boat with an inverted J-shaped cross section, the short leg of the J descending downwardly on the interior of the boat to said horizontal transverse pivot point, the long leg of the J descending downwardly on the exterior of said pre-existing transom, said transom jacket connected to said mounting means along said horizontal transverse pivot point to enable said transom jacket to be tilted from a first position to a second position, (c) said planar members of said transom jacket defining an outboard motor mount for securing one or more outboard motors to said boat, said outboard motor mount being defined above said horizontal transverse pivot point, said motors being mounted with their mounting clamps directly over the pre-existing boat transom when said transom jacket is in its first position, said transom jacket being arranged to pivot about said pivot point to bring said motor upwardly and inwardly of said pre-existing transom when said transom jacket is tilted to its second position, (d) power cylinder mounting means mounted on the exterior of said pre-existing boat transom, (e) power cylinder means mounted to one of the downwardly descending legs of said transom jacket to tilt said transom jacket upwardly and inwardly of said pre-existing transom when said power cylinder is energized.

16. A powered tilting transom as claimed in claim 15 wherein said tilting transom further comprises an outboard motor lock, said lock defining a pair of extension arms and a front locking bar adapted to secure said outboard motors to said tilting transom jacket.

* * * * *